United States Patent [19]

Braun et al.

[11] 4,121,485

[45] Oct. 24, 1978

[54] TOOL FOR REMOVING A WATCH CASE BACK

[76] Inventors: Carl G. Braun, 64 Orchard Ave., Woodbury, Conn. 06798; William S. Dolan, Straits Turnpike, Middlebury, Conn. 06762

[21] Appl. No.: 693,547

[22] Filed: Jun. 7, 1976

[51] Int. Cl.[2] ..... G04D 1/10

[52] U.S. Cl. ..... 81/6; 81/125; 29/239

[58] Field of Search ..... 81/6, 3.34, 3.4, 90 R, 81/90 C, 125, 3.46 A, 90 B, 90 D, 119, 120, 121 R, 122; 29/239, 253, 245; 285/396, 360, 361

[56] References Cited

U.S. PATENT DOCUMENTS

| | | | |
|---|---|---|---|
| 769,873 | 9/1904 | Paar | 81/6 |
| 1,127,836 | 2/1915 | Whalen et al. | 81/120 |
| 1,561,003 | 11/1925 | LeLoup | 81/121 R |
| 2,985,242 | 5/1961 | Papa | 81/90 R |
| 2,987,080 | 6/1961 | Chandler et al. | 81/90 R |
| 3,161,090 | 12/1964 | McLellan | 81/120 |

*Primary Examiner*—James L. Jones, Jr.
*Assistant Examiner*—Roscoe V. Parker
*Attorney, Agent, or Firm*—H. M. Snyder

[57] ABSTRACT

A tool capable of removing the back of a watch from a watch case in which the watch back is of the type having an edge projection on its periphery. The watch back is received in a cylindrical cavity of the tool which has an internal inclined camming surface for contact with the edge projection on the watch back. Rotating the tool with the edge projection engaged by the inclined camming surface lifts the watch back away from the watch case.

3 Claims, 5 Drawing Figures

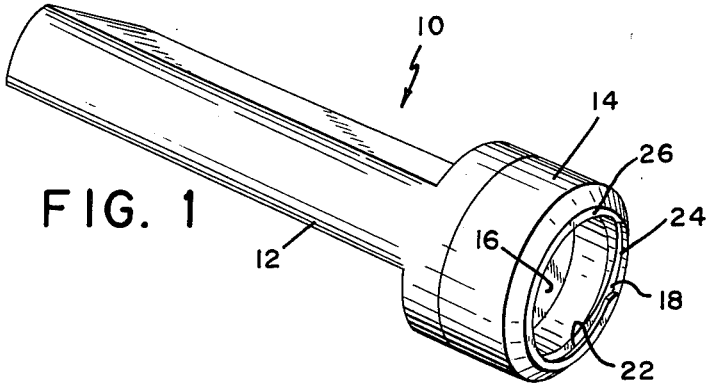
FIG. 1
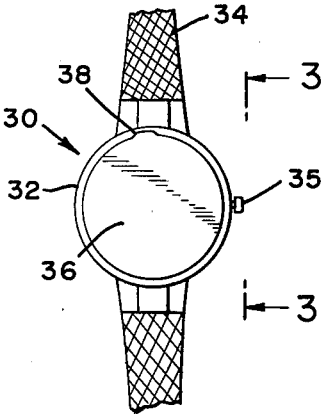
FIG. 2
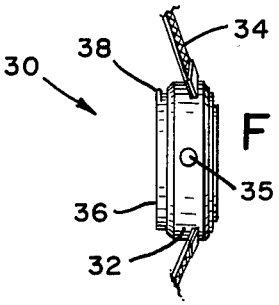
FIG. 3
FIG. 4
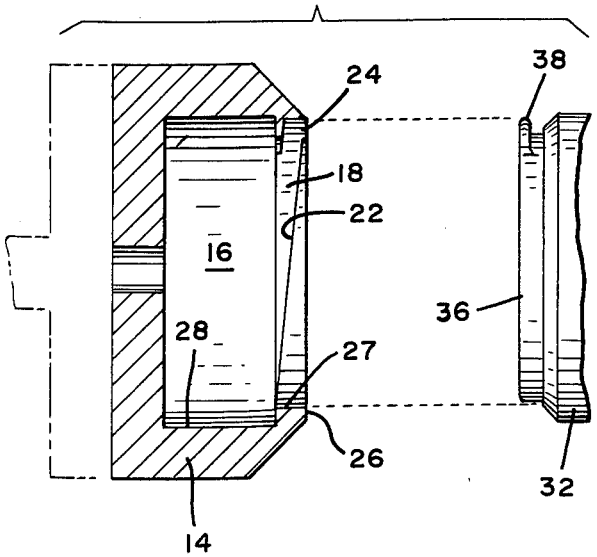
FIG. 5
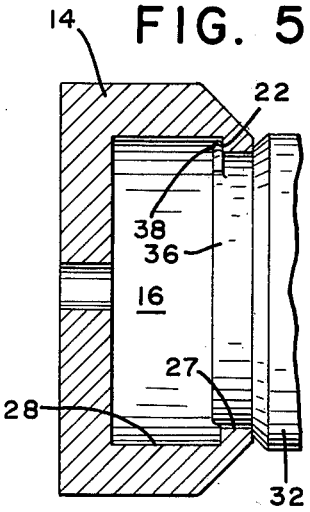

TOOL FOR REMOVING A WATCH CASE BACK

This invention is directed to a novel tool for removing the backs of watches.

In the field of watch repair there is a need for tools which will remove the backs of watches with positive, precise, yet gentle action. The long-continued search for such tools is illustrated by U.S. Pat. No. 451,982 to D. Southworth (1891), U.S. Pat. No. 659,049 to D. W. Campbell et al (1900), U.S. Pat. No. 769,873 to R. H. Paar (1904), U. S. Pat. No. 1,313,271 to H. C. Danner (1919) and U. S. Pat. No. 3,209,624 To J. Schiffman (1965).

The present invention is directed to such a tool for those watch backs which have a structure which includes an edge projection on the periphery thereof to aid in removal of the back.

It is an object of this invention to provide a tool for removing the backs of watch cases which is sturdy, simple to operate and effective.

It is a further object of this invention to provide a tool for removing the backs of watch cases which will smoothly lift a watch back out of the watch case and accommodate the watch back so removed.

Other objects and advantages of the invention will become apparent from the following description taken in conjunction with the accompanying drawings in which:

FIG. 1 is a perspective view of the tool of the invention;

FIG. 2 is a plan view of a watch showing the type of watch back of concern in the present invention;

FIG. 3 is a view taken along the line 3—3 of FIG. 2;

FIG. 4 is a detailed sectional view of the tool head of the invention with a view of the watch back prior to contact with the tool; and FIG. 5 is a view similar to that of FIG. 4, following operation of the tool, with the watch back very nearly removed.

In accordance with this invention, an inclined camming surface is provided on a tool to engage a watch back edge projection and lift it, and with it the watch back, away from the watch case. The inclined camming surface or thread of the tool is located on the periphery of a cylindrical cavity. By rotating the tool while in contact with the watch case, the inclined camming surface or thread is brought into contact with the peripheral edge projection, thereby exerting a steady upward force on the edge projection to lift the watch back out of and away from the watch case and into the cylindrical cavity.

Referring to the drawings, the tool is shown in FIG. 1, in an overall view, with handle 12 connected to the watch-contacting tool head 14. The head 14 has a cylindrical cavity 16 in the interior thereof with a narrower mouth portion 27 opening onto the face of the tool. A peripheral inclined camming surface or thread 22 is provided on the wall of mouth 27 (See FIG. 4).

The watch 30, shown in FIGS. 2 and 3, has a watch case 32 mounted on a watch band 34. A time set knob 35 is provided on watch case 32. It will be noted that watch 30 has a disc-like watch back 36 which is force fit in watch case 32 and has a projection 38 on the periphery thereof to facilitate removal of the watch back.

The operation of the tool 10 can best be understood by referring to FIGS. 4 and 5. In FIG. 4, the tool head 14 is shown with the watch back 36 just before the tool head 14 is applied to the watch case 32. The watch back 36 is of a diameter which will closely fit into the mouth portion 27 of cavity 16. The projection 38 on the periphery of watch back 36 extends generally outside the dimensions of the mouth portion 27, but a passage 24 (essentially a cut-out portion) is provided in the top surface 26 of the tool head 14 so that the edge projection 38 can pass into mouth portion 27 for contact with the inclined surface 22. Once the edge projection 38 is within mouth portion 27, it is brought into contact with the inclined surface 22 by rotating the tool. At this same time, the top surface 26 of the tool head is in contact with watch case 32. As seen in FIG. 4, clockwise rotation of the tool (in a plane perpendicular to the plane of the paper), while the watch case is restrained against rotations, will bring the inclined surface 22 into engagement with the edge projection 38. Continued rotation of the tool, with top surface 26 of the tool head 14 in contact with the non-rotating watch case 32, smoothly forces the inclined surface 22 against the edge projection 38. As seen in FIG. 5, the edge projection 38, and hence the watch back 36, is forced out of the watch case 32 by this continued pressure. As the watch back 36 moves outward it is guided by the encompassing wall of the mouth portion 27. FIG. 5 shows the inclined surface 22 in contact with the under side of edge projection 38. Ultimately, the watch back 36 is pulled entirely free of the watch case 32 and can fall into cavity 16 from which it can readily be retrieved.

It will be understood that the tool head 14 may be removably attached to the handle element 12 by machine screws or other suitable attachment devices. This feature is convenient when it is desired to fit tool heads of various sizes to the handle element to accommodate the several sizes of watch backs which are or may become available.

The tool head is preferably made of a non-abrasive material; i.e., a metal such as aluminum or steel or a suitable plastic material. The handle element can be satisfactorily made from plastic or other conventional handle materials.

There has thus been presented a sturdy tool for removing watch backs which is remarkably simple in operation, but which does not exert excessive force on the watch case or watch back.

Although the present invention has been described in conjunction with its preferred embodiment, it is to be understood that modifications and variations may be resorted to without departing from the spirit and scope of the invention as those skilled in the art will readily understand. Such modifications and variations are considered to be within the purview and scope of the invention and appended claims.

We claim:

1. A tool for removing watch backs from watch cases, suitable for use with watch backs having a peripheral edge projection, comprising a cylindrical cavity having a side wall a relatively closed bottom wall and a relatively open top forming a mouth portion for encompassing a watch back, the side wall of said cylindrical cavity having a top edge about said mouth portion for engaging the watch case, an inclined camming surface in said side wall peripheral of said cavity and an entry passage in said top edge for admitting said edge projection of said watch back to said inclined camming surface.

2. A tool according to claim 1 wherein said top edge of said wall is essentially flat.

3. A tool in accordance with claim 1 wherein said inclined camming surface is confined to the upper portion of said cylindrical cavity and the lower portion of said cylindrical cavity constitutes a watch back receiving chamber.

* * * * *